US005417565A

United States Patent [19]

Long

[11] Patent Number: 5,417,565

[45] Date of Patent: May 23, 1995

[54] AUTOMATIC INSTANT LIGHTING SYSTEM FOR LIQUID FUEL BURNER

[75] Inventor: Norris R. Long, Wichita, Kans.

[73] Assignee: The Coleman Company, Inc., Wichita, Kans.

[21] Appl. No.: 324,258

[22] Filed: Oct. 17, 1994

[51] Int. Cl.[6] ..... F23D 11/44

[52] U.S. Cl. ..... 431/231; 431/203; 431/344; 126/38; 137/519

[58] Field of Search ..... 126/41 R, 38, 44, 39 R; 261/69.1; 431/344, 203, 231, 207, 123; 137/519.5, 893, 895, 519

[56] References Cited

U.S. PATENT DOCUMENTS

| | | | |
|---|---|---|---|
| Re. 24,457 | 10/1977 | Hastings . | |
| 1,013,822 | 1/1912 | Sharp . | |
| 1,127,455 | 2/1915 | Krauss . | |
| 1,749,629 | 3/1930 | Coleman . | |
| 1,852,845 | 4/1932 | Hanson | 431/231 |
| 1,887,140 | 11/1932 | Risinger | 431/231 |
| 2,025,837 | 12/1935 | Tullis . | |
| 2,139,819 | 12/1938 | Graetz | 431/231 |
| 2,321,034 | 6/1943 | Lieber | 431/231 |
| 2,553,817 | 5/1951 | Erland Af Kleen . | |
| 3,876,364 | 4/1975 | Hefling | 126/38 |
| 3,933,146 | 1/1976 | Hastings | 126/38 |
| 4,825,897 | 5/1989 | Shade | 137/519.5 |
| 5,336,084 | 8/1994 | Long | 126/38 |

*Primary Examiner*—James C. Yeung

[57] ABSTRACT

A fuel control mechanism for a liquid fuel burner includes a fuel regulating valve which is responsive to flow of liquid fuel through a fuel feed tube for movement between a starting position and a running position. When a fuel control valve for the burner is opened, flow of liquid fuel through the fuel feed tube moves the fuel regulating valve to a starting position in which the fuel regulating valve restricts flow of fuel through a fuel inlet. Air is thereby drawn through an air inlet and mixes with the fuel. After the burner is started and liquid fuel is vaporized within the generator, flow of fuel through the fuel feed tube slows, and the fuel regulating valve falls by virtue of its weight to the running position in which the fuel regulating valve does not restrict flow of fuel through the fuel inlet. Air flow through the air inlet is thereby discontinued, and only liquid fuel flows through the fuel feed tube.

12 Claims, 4 Drawing Sheets

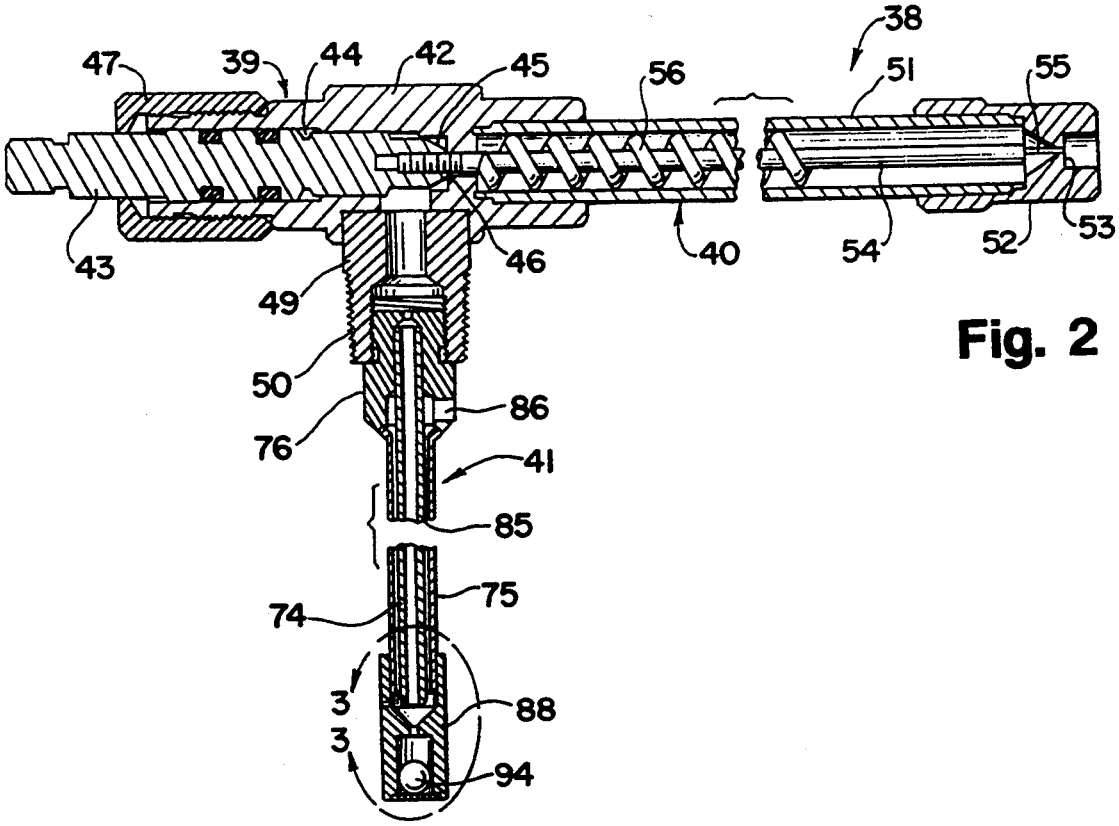
Fig. 2
Fig. 3
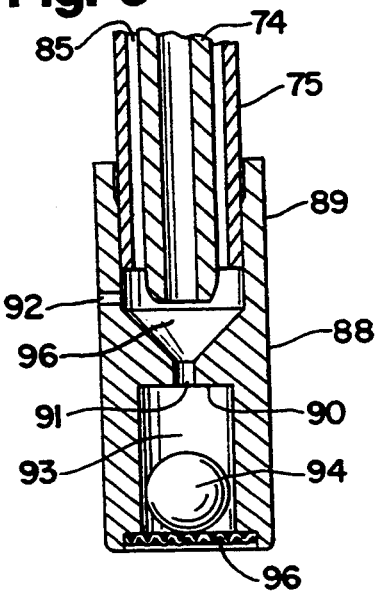
Fig. 4
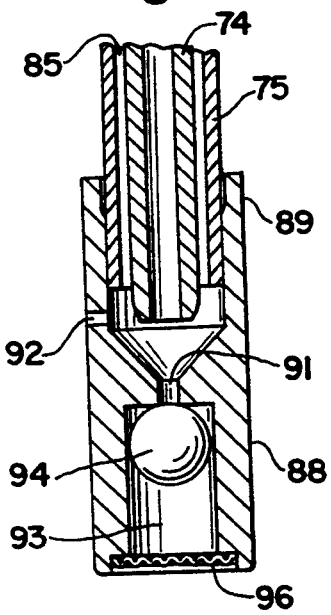

Fig. 10
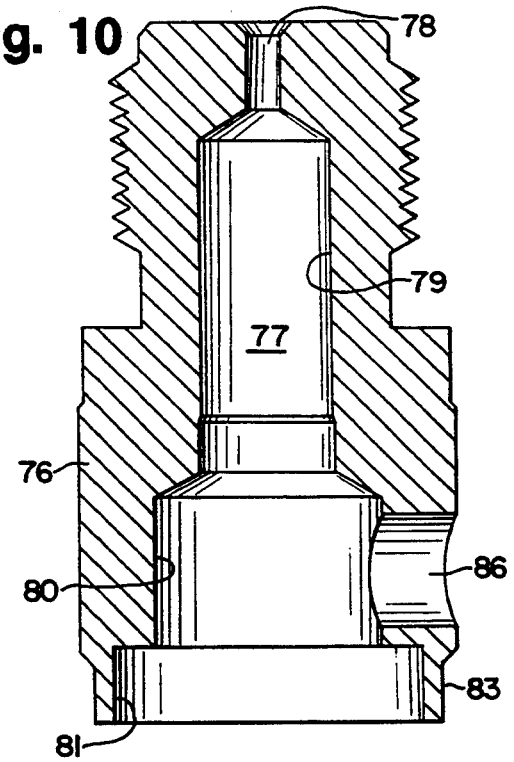
Fig. 8
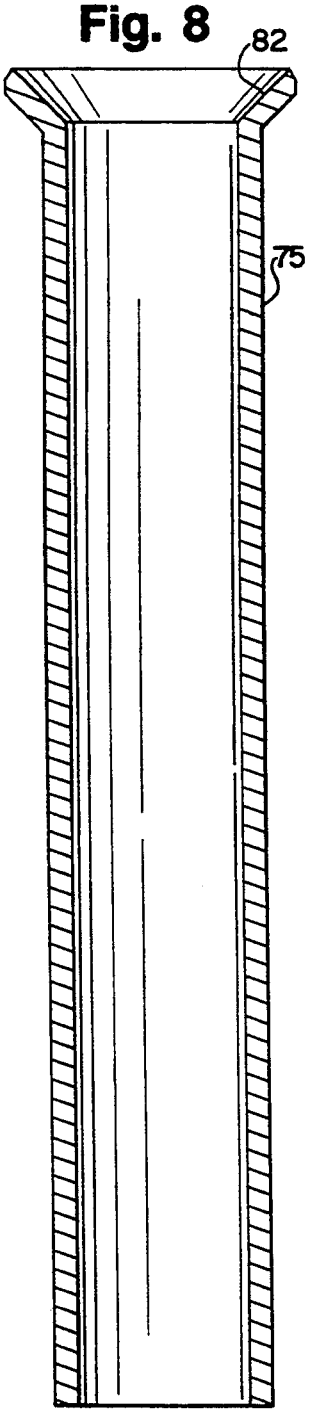
Fig. 9
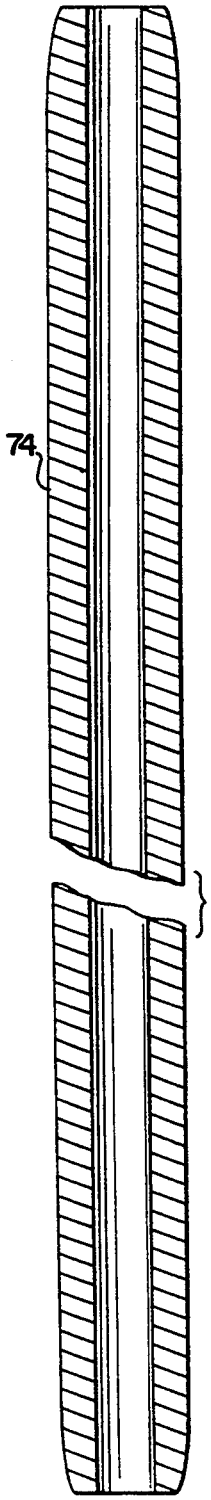
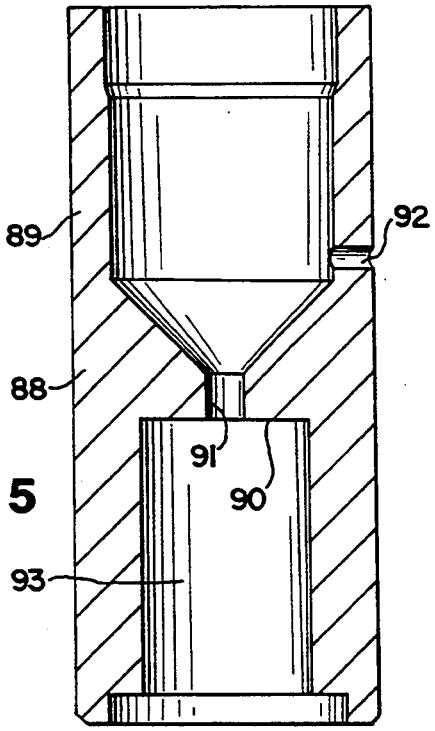
Fig. 5
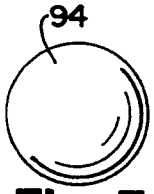
Fig. 7
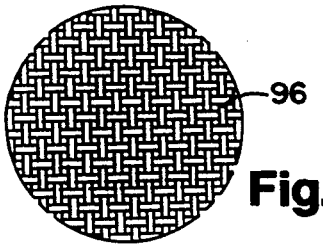
Fig. 6

AUTOMATIC INSTANT LIGHTING SYSTEM FOR LIQUID FUEL BURNER

BACKGROUND

This invention relates to liquid fuel burner appliances such as campstoves and utility stoves. More particularly, the invention relates to an automatic instant lighting system for liquid fuel burning campstoves.

Liquid fuel campstoves and lanterns for camping and outdoor use are well known and are described, for example, in U.S. Pat. No. 3,876,364, which is owned by The Coleman Company, Inc. Liquid fuel which is used in such campstoves and lanterns can be Coleman fuel, white gas, unleaded gasoline, etc.

In conventional liquid fueled campstoves such as the ones which Coleman has offered for many years, fuel is contained in a pressure vessel or fuel tank into which air is pumped under pressure. As described in U.S. Pat. No. 3,876,364, the fuel tank is equipped with a dip tube which extends to nearly the bottom of the tank. The dip tube is closed at the bottom with the exception of a small diameter orifice through which fuel is allowed to enter. The dip tube has an internal conduit which is open at the bottom and which communicates with the upper part of the pressure vessel above the maximum intended fuel level. The dip tube orifice can be partly blocked by insertion of a needle which is suitably connected to the fuel control system so as to cause it to partly block the orifice during the lighting cycle and to leave the orifice unblocked during the normal burn cycle. This partial blockage during the lighting cycle causes air to be drawn down the space between the internal and outer conduits of the dip tube from an opening at the upper part of the pressure vessel. As this air accompanies fuel up the internal conduit, a mixture of fuel and air more suitable for burning is created to enhance lighting. The air fuel mixture then passes to a generator which is connected to the dip tube by the fuel control system. The generator is a metal tube which passes above the burner of the stove into a venturi assembly which is connected to the burner. Fuel is discharged at high velocity from an orifice or jet at the end of the generator into the venturi where air is aspirated and mixed and fed to the burner as a combustible mixture for burning.

In U.S. Pat. No. 3,876,384, the restricting needle is operated by rotating the fuel control knob. In other appliances, a lever is used to adjust the appliance for starting and running. The lever is moved up to start and then down to run.

In the case of liquid fueled appliances which have a relatively low ratio of fuel delivery required at full output and at minimum output, it is possible to rely upon increases in resistance to the flow of fuel which occur due to heating of the generator to allow air to flow down through the passageway between the inner and outer conduits of the dip tube so as to provide an air rich mixture for lighting and so as to prevent air from filling that passageway and mixing with the fuel when the generator is hot. This system is used on Coleman liquid fueled lanterns which have been sold for many years. Campstoves and utility stoves require a relatively high ratio of heat output between low simmer and full output and it has heretofore not proven possible to achieve the necessary air flow differentials for proper operation of these devices without use of the manually operated system described above.

The foregoing structure for allowing liquid fuel appliances to be lighted when the generator is cold is referred to as an instant lighting system. Liquid fuel appliances which do not include an instant lighting system require some other means for heating the generator during start-up, for example, liquid priming fuel or heating paste.

SUMMARY OF THE INVENTION

The invention allows a liquid fuel appliance to be lighted and run without moving a knob or lever to adjust the instant lighting system. A fuel feed tube assembly includes a regulating valve member which is light enough to be responsive to the flow of fuel through the fuel inlet of the fuel feed tube. When the fuel control valve is opened, fuel flows relatively rapidly through the fuel inlet, and the regulating valve is moved by the fuel flow to block or restrict the flow of fuel through the fuel inlet. The reduced fuel flow rate allows air to be incorporated into the fuel as previously described. When the generator is heated sufficiently to vaporize the fuel, the flow of fuel through the fuel feed tube slows. The regulating valve then falls to open the fuel inlet, and only liquid fuel without air flows through the fuel feed tube.

DESCRIPTION OF THE DRAWING

The invention will be explained in conjunction with illustrative embodiments shown in the accompanying drawing, in which

FIG. 2 is a fragmentary sectional view of the generator and fuel feed assembly of the campstove;

FIG. 3 is an enlarged fragmentary sectional view of the bottom portion of the fuel feed tube assembly within the circle 3—3 of FIG. 2;

FIG. 4 is a view similar to FIG. 3 showing the fuel-regulating valve in the restricting position;

FIG. 5 is an enlarged sectional view of the fuel tip;

FIG. 6 is a plan view of the screen for the fuel tip;

FIG. 7 is a view of the fuel-regulating ball valve;

FIG. 8 is a sectional view of the outer tube or air tube of the fuel feed tube assembly;

FIG. 9 is a fragmentary sectional view of the inner tube or fuel tube of the fuel feed tube assembly;

FIG. 10 is a sectional view of the fuel feed tube connector;

DESCRIPTION OF SPECIFIC EMBODIMENTS

Figure 1:
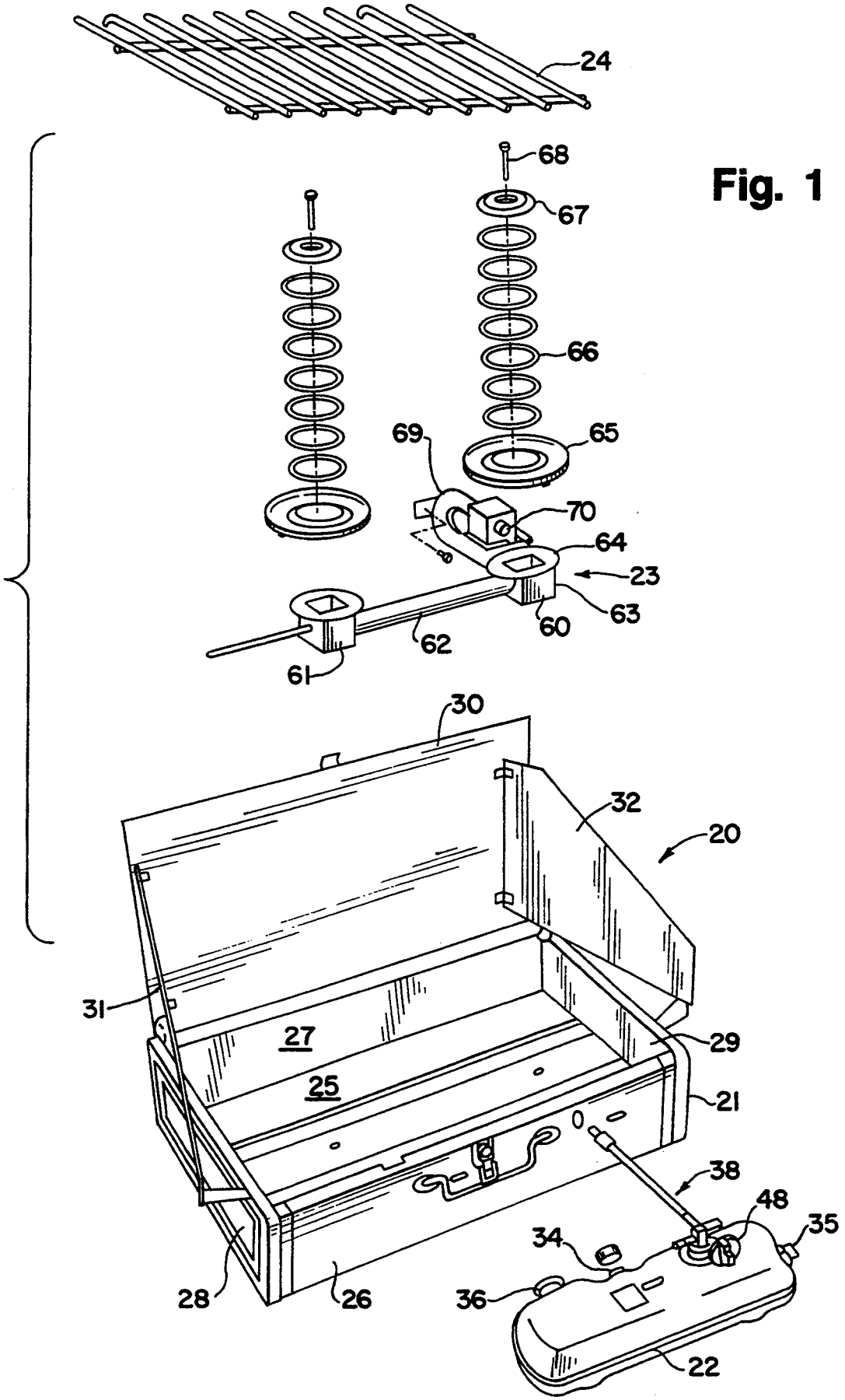
FIG. 1 is an exploded perspective view of a liquid fuel campstove.
Figure 11:
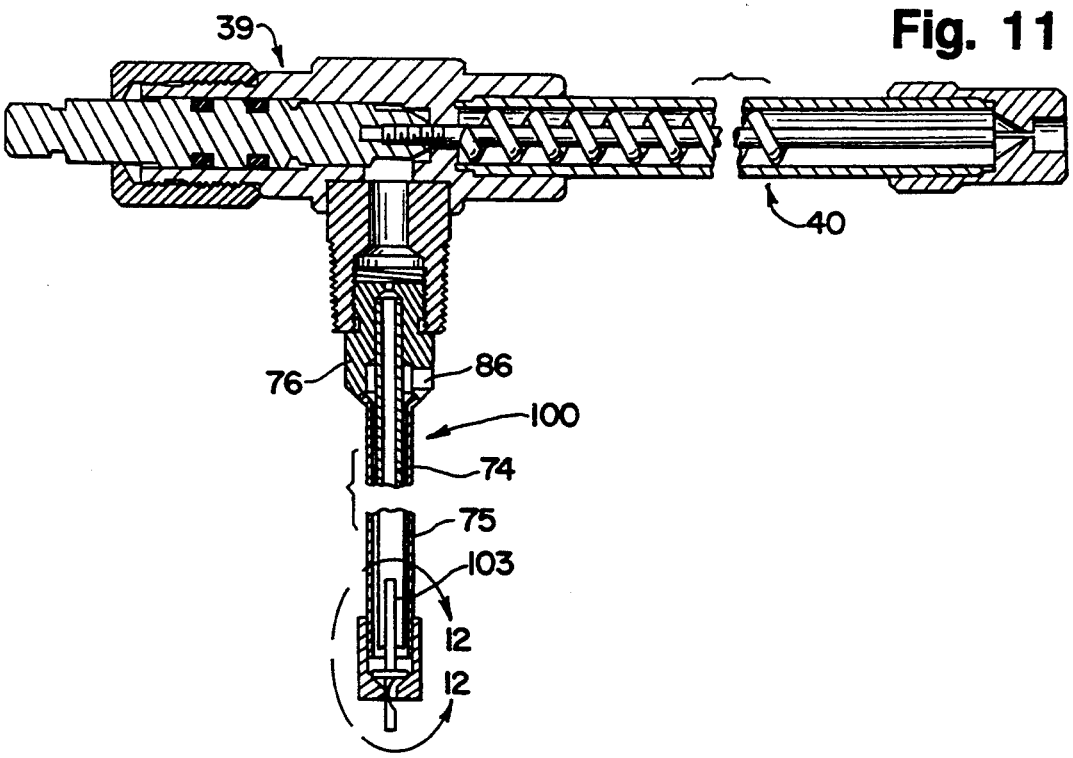
FIG. 11 is a view similar to FIG. 2 of an alternate embodiment.

The invention will be explained with reference to a campstove 20 illustrated in FIG. 1. However, the invention can also be used in lanterns and other liquid fuel appliances.

The campstove 20 includes a case 21, a liquid fuel tank 22, a burner assembly 23, and a grate 24. The case 21 includes a bottom wall 25, front and back walls 26 and 27, a pair of side walls 28 and 29, and a lid 30 which is hingedly secured to the back wall 27. A pair of windscreens 31 and 32 are hingedly secured to the bottom surface of the lid.

The fuel tank 22 is a conventional Coleman liquid fuel tank which includes a fill spout 34 and an air pump assembly 35. The fuel tank is removably mounted on the front wall of the case by a pair of mounting hooks 36 which can be inserted through slots in the front wall.

A generator and fuel feed assembly 38 is threadedly secured to the top of the fuel tank. Referring to FIG. 2, the assembly 38 includes a fuel control valve assembly 39, a generator assembly 40, and a fuel feed tube assembly 41.

The control valve assembly and generator assembly can be conventional. The control valve assembly includes a valve housing 42 and a valve stem 43 which is threadedly engaged in a central bore 44 of the housing. The inner end 45 of the valve stem is tapered and cooperates with a valve seat 46 in the valve housing to shut off fuel flow through the valve housing. The outer end of the valve stem extends through a nut 47 on the valve housing, and the valve stem can be rotated by a knob 48 (FIG. 1). A bushing 49 extends downwardly from the valve housing and includes external threads 50 for engaging the fuel tank.

The generator assembly includes a generator tube 51, an end cap 52 which is provided with a fuel orifice or jet nozzle 53, and a rod 54 which is threadedly secured to the valve stem 43. A needle 55 is mounted on the end of the rod 54 and extends through the jet nozzle 53 when the valve is closed. A helical spring 56 surrounds the rod for improving heat transfer to the fuel which flows through the generator tube.

Referring again to FIG. 1, the burner assembly 23 includes a main burner 60 and an auxiliary burner 61 which are connected by a crossover tube 62. Each of the burners is a conventional Coleman burner and includes a burner box 63 having a top flange 64, a burner bowl 65 which is supported by the top flange, a plurality of burner rings 66, and a cap 67. A bolt 68 is screwed into a bushing on the burner box and clamps the parts of the burner together. The particular burner rings illustrated have been sold for many years under the trademark Band-A-Blu and are described, for example, in U.S. Pat. No. 3,933,146. The burner rings include alternating flat and corrugated rings which provide a plurality of fuel outlet orifices. A generally U-shaped venturi or bunsen tube 69 includes an open end 70 and a second or bottom end which extends into an inlet opening in the burner box 63 of the main burner 60.

When the fuel tank 22 is mounted on the case 21, the generator tube 51 extends through an opening in the front wall of the case, over the main burner 60, and into the open end 70 of the venturi tube 69.

Referring now to FIGS. 2–4, the fuel feed tube assembly 41 includes a pair of inner and outer concentric tubes 74 and 75, the upper ends of which are secured to a connector 76. The connector 76 is screwed into the bushing 49 of the valve assembly.

The connector is provided with a central bore 77 (FIG. 10). The bore includes a plurality of stepped portions of increasing diameter—an upper outlet portion 78 having a small diameter, a second portion 79 of larger diameter, a larger third portion 80, and an end portion 81. The inner tube 74 (see also FIG. 9) is secured within the portion 79 by an interference fit and may be further secured by brazing. The upper end of the outer tube 75 includes a flared flange 82 (FIG. 8) which is sized to be inserted into the portion 81 of the bore, and the outer tube is secured by crimping the thin end wall 83 which forms the bore 81 against the flange 82.

An annular air passage 85 (FIGS. 2–4) is formed between the inner and outer tubes 74 and 75, and the air passage communicates with the upper portion of the fuel tank through an air inlet 86 (FIG. 10) in the connector 76. The air inlet 86 is positioned above the fuel level in the fuel tank when the tank is full.

A fuel tip 88 is secured to the bottom of the outer tube 75. The fuel tip includes a cylindrical side wall 89 and a transverse wall 90. A main fuel inlet opening 91 is provided in the transverse wall 90, and a smaller side fuel inlet opening 92 is provided through the side wall 89.

The side wall 89 extends below the transverse wall 90 and forms a compartment 93 for a fuel regulating ball valve 94. The ball 94 is retained within the compartment by a porous mesh disc 95 (see also FIG. 6) which is secured within the open bottom end of the fuel tip.

The fuel feed tube assembly 41 is immersed in the liquid fuel contained by the fuel tank 22. The bottom end of the fuel tip 88 is positioned adjacent the bottom of the fuel tank, and the air inlet opening 86 is positioned above the level of the liquid fuel when the fuel tank is full. The fuel tank is pressurized with air by operating the air pump 35.

When the control valve 39 is opened, fuel is forced through the fuel feed tube assembly and the generator tube by the air pressure. As the fuel flows rapidly upwardly through the chamber 93 and inlet orifice 91 of the fuel tip 88, the ball 94 is carried upwardly by the fuel until it engages the transverse wall 90. The ball 94 plugs the inlet opening 91 and prevents fuel from flowing through the inlet opening. A low pressure area above the ball is thereby created which draws liquid fuel through the side fuel inlet 92. The side fuel inlet 92 is smaller than the main fuel inlet opening 91, and the flow of liquid fuel through the opening 92 is less than would flow through the opening 91 without the ball. The continued low pressure area above the ball causes air to be drawn through the air inlet opening 86 and the annular air passage 85. The air mixes with the fuel in a mixing chamber 96 below the bottom end of the inner fuel tube 74. The fuel/air mixture flows upwardly through the inner fuel tube 74 and into the generator tube 51 and is discharged through the jet orifice 53 in the form of fuel-vapor-laden air and atomized droplets of fuel. As the fuel/air mixture flows through the venturi tube 69, additional outside air is aspirated into the mixture through the opening 70. As the fuel/air mixture flows into the main burner 60, it can be ignited by a lit match, sparking device, or the like.

After the burner is ignited, the flame of the burner heats the generator assembly 40 and vaporizes the fuel in the generator. As the fuel is vaporized, the fuel takes more volume in the generator, and flow through the inner fuel feed tube 74 is reduced. The fuel flow eventually is reduced to a point where the pressure above and below the main fuel inlet opening approaches equilibrium and the ball 94 can no longer be held up by the fuel flow. The ball then falls to the mesh or screen 96. Without the ball 94 blocking the main fuel inlet opening 91, fuel is free to flow through the main inlet opening 91. Fuel flow through the main inlet opening 91 is sufficient to satisfy the flow through the generator tube, and there is insufficient suction to draw air downwardly through the annular air passage 85 so that only fuel without air flows upwardly through the inner fuel tube 74.

The generator assembly 40 does not always vaporize fuel smoothly, which may cause a pulsing action in the inner fuel tube 74. The pulsing action can cause the ball 94 to move up and down and partially block the main fuel inlet opening 91. The pulsing action is dampened by the small outlet orifice 78 (FIG. 10) at the upper end of the connector 76.

As long as the burner remains lighted, fuel will be vaporized in the generator assembly, and the ball will remain in its lower position so that only liquid fuel flows through the generator.

The mesh 96 not only supports the ball 94 in its lower position but also screens small particles from the chamber 93 which might interfere with free movement of the ball.

In the embodiment illustrated in FIGS. 2–4, the ball 94 regulates the flow of fuel and air through the inner fuel tube 74 by moving between a lower or running position in which the fuel inlet opening 91 is unobstructed and a start position in which the fuel inlet opening 91 is blocked by the ball. It is also possible to design the inlet opening 91 so that the inlet opening 91 is not completely obstructed by the ball in the start position and some fuel can flow through the inlet opening. The side inlet opening 92 can then be modified or omitted.

The size and weight of the ball 94, the size of the fuel inlet opening 91 and the diameter of chamber 93 are selected so that the ball will drop under its own weight when the generator is heated sufficiently to vaporize the fuel. The ball is advantageously made from plastic.

Another embodiment of a fuel regulating device is illustrated in FIGS. 11–14. The fuel feed tube assembly 100 is identical to the fuel feed tube assembly 41 except for the lower end portion which is indicated by the circle 12—12. A fuel tip 101 is connected to the lower end of the outer air tube 75 and includes a fuel inlet opening 102. A metal restricting rod 103 acts as a fuel regulating valve and includes a shank 104 and a cylindrical piston or flange 105. The shank includes an upper portion 106 which extends into the inner fuel tube 74 and a lower portion 107 which extends through the fuel inlet opening 102. The piston 105 is sized to engage the bottom end of the outer air tube 75 but not obstruct flow of fuel past the piston and into the fuel tube 74. The lower portion 107 of the restricting rod includes a restricting portion **107*a* which has a diameter slightly less than the diameter of the inlet opening 102 and a necked-down or small diameter portion 107*b***.

Figure 12:
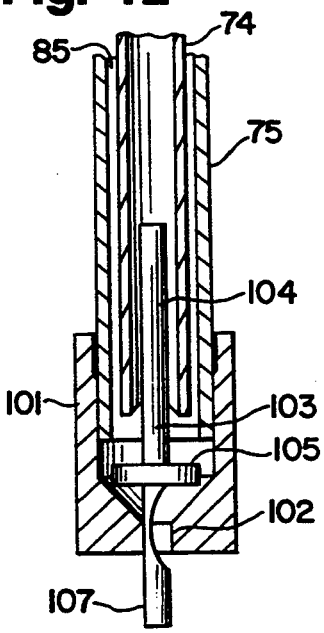
FIG. 12 is an enlarged fragmentary view of the portion of FIG. 11 within the circle 12—12.
Figure 13:
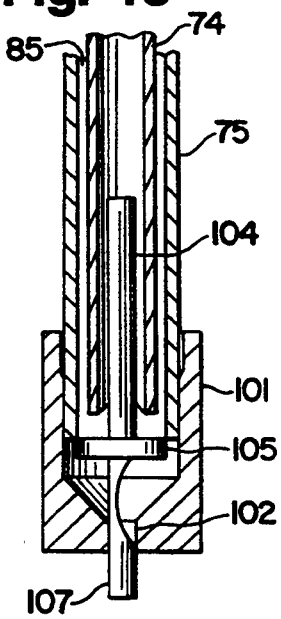
FIG. 13 is a view similar to FIG. 12 showing the fuel-regulating valve in the restricting position.
Figure 14:
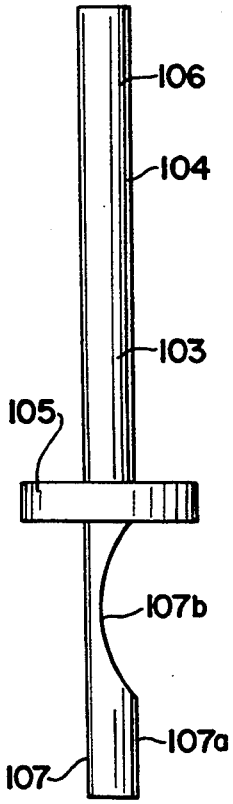
FIG. 14 is an elevational view of the fuel regulating valve of FIGS. 11–13.

When the fuel valve is opened, fuel flows upwardly through the fuel inlet opening 102 and acts on the piston 105 to carry the restricting rod 103 from a lower position illustrated in FIG. 12 to an upper position illustrated in FIG. 13. In the upper position fuel flow through the inlet opening 102 is reduced by the restricting portion **107*a*, and air is drawn downwardly through the annular air passage 85 and mixes with the fuel. After the generator is heated sufficiently to vaporize the fuel, the reduced upward flow through the fuel tube 74 allows the restricting rod 103 to fall to its lower position in which the non-restricting portion 107*b* is positioned in the inlet opening. The fuel flow through the inlet opening 102 is sufficient to satisfy the fuel flow through the generator, and no air is drawn downwardly through the annular air passage 85 so that only liquid fuel flows upwardly through the inner fuel tube 74**.

The diameter of orifice 102 and the size of rod 107 are selected so that a reduced amount of fuel for lighting is allowed to flow to the burner.

While in the foregoing specification a detailed description of specific embodiments of the invention was set forth for the purpose of illustration, it will be understood that many of the details herein given may be varied considerably by those skilled in the art without departing from the spirit and scope of the invention.

I claim:

1. A fuel control mechanism for a liquid fuel burner comprising:

a burner, a fuel tank for storing liquid fuel, a feed tube assembly mounted in the fuel tank and having upper and lower ends, the lower end adapted to be immersed in liquid fuel and having fuel inlet means for allowing liquid fuel to flow from the fuel tank into the feed tube assembly, the feed tube assembly having a fuel passage extending from adjacent the lower end of the feed tube assembly to the upper end of the feed tube assembly and an air passage extending from adjacent the upper end of the feed tube assembly to the lower end of the fuel passage, a conduit for conducting fuel from the upper end of the fuel tube assembly to the burner, the conduit including a generator tube positioned adjacent the burner whereby when the generator tube is heated by the burner, fuel within the generator tube is vaporized, a control valve operably connected to the conduit for opening and closing the conduit, regulating means movably mounted in the lower end of the fuel feed tube assembly for movement between a starting position in which the regulating means restricts flow of liquid fuel through the fuel inlet means and a running position in which the regulating means allows unrestricted flow of liquid fuel through the fuel inlet means, the regulating means being responsive to flow of liquid fuel through the fuel inlet means when the control valve is opened for moving to the starting position for restricting the flow of liquid fuel through the fuel inlet means whereby air flows from the upper portion of the fuel tank through the air passage and into the fuel passage and is entrained with liquid fuel which flows through the fuel inlet means into the fuel passage, the regulating means falling to the running position when fuel in the generator tube is vaporized whereby flow of liquid fuel through the inlet means is unrestricted and flow of air through the air passage is discontinued.

2. The fuel control mechanism of claim 1 in which the fuel inlet means includes a bottom fuel inlet opening at the lower end of the feed tube assembly and a side fuel inlet opening above the bottom fuel inlet opening, the regulating means substantially closing the bottom fuel inlet opening when the regulating means is in the starting position.

3. The fuel control mechanism of claim 2 in which the regulating means comprises a regulating valve member which is moved against the bottom fuel inlet opening by the flow of liquid fuel when the control valve is opened.

4. The fuel control mechanism of claim 3 including a porous member mounted on the lower end of the fuel tube assembly below the bottom fuel inlet opening for supporting the regulating valve member in the running position.

5. The fuel control mechanism of claim 3 in which the regulating valve member is a ball.

6. The fuel control mechanism of claim 1 in which the fuel inlet means comprises a fuel inlet opening at the lower end of the fuel tube assembly, the regulating means including a restricting rod positioned in the fuel inlet opening and having a small-diameter portion and a large-diameter portion below the small-diameter portion, the large-diameter portion of the restricting rod being positioned in the fuel inlet opening when the regulating means is in the starting position and the small-diameter portion of the restricting rod being positioned in the fuel inlet opening when the regulating means is in the running position.

7. The fuel control mechanism of claim 6 in which the restricting rod includes an elongated shank and a flange which extends transversely outwardly from the shank.

8. A fuel control mechanism for a liquid fuel burner comprising:

a burner, a generator tube positioned adjacent the burner, a fuel tank for storing liquid fuel, a fuel feed tube assembly mounted in the fuel tank and having upper and lower ends, the lower end of the fuel feed tube assembly adapted to be immersed in liquid fuel, a conduit for conducting fuel from the upper end of the fuel feed tube assembly to the generator tube, a control valve in the conduit for opening and closing the conduit, the improvement characterized by the fuel feed tube assembly comprising:

an inner fuel tube communicating with said conduit, an outer air tube surrounding the inner fuel tube and providing an annular air passage therebetween, the fuel tube assembly having an air inlet to the annular air passage in an upper portion of the fuel feed tube assembly, a fuel tip connected to the air tube at the lower end of the fuel feed tube assembly, fuel tip including a generally cylindrical side wall and a transverse wall which extends below the air tube and fuel tube, the side wall having a side fuel inlet and the transverse wall having a bottom fuel inlet, a regulating valve member movably mounted within the cylindrical side wall of the fuel tip below the transverse wall for movement between a starting position in which the regulating valve member restricts flow of liquid fuel through the bottom fuel inlet and a running position in which the regulating valve member does not restrict flow of liquid fuel through the bottom fuel inlet, the regulating valve member being responsive to flow of liquid fuel through the bottom fuel inlet when the control valve is opened for moving to its starting position for restricting the flow of liquid fuel through the bottom fuel inlet whereby air flows from the upper portion of the fuel tank through the air passage and into the fuel passage and is entrained with liquid fuel which flows through the side fuel inlet into the fuel passage, the regulating valve member falling to the running position when fuel in the generator tube is vaporized whereby flow of liquid fuel through the bottom fuel inlet is unrestricted and flow of air through the air passage is discontinued.

9. The fuel control mechanism of claim 8 including a porous member mounted on the lower end of the fuel tube assembly below the bottom fuel inlet opening for supporting the regulating valve member in the running position.

10. The fuel control mechanism of claim 9 in which the regulating valve member is a ball.

11. A fuel control mechanism for a liquid fuel burner comprising:

a burner, a generator tube positioned adjacent the burner, a fuel tank for storing liquid fuel, a fuel feed tube assembly mounted in the fuel tank and having upper and lower ends, the lower end of the fuel feed tube assembly adapted to be immersed in liquid fuel, a conduit for conducting fuel from the upper end of the fuel tube assembly to the generator tube, a control valve in the conduit for opening and closing the conduit, the improvement characterized by the fuel feed tube assembly comprising:

an inner fuel tube communicating with said conduit, an outer air tube surrounding the inner fuel tube and providing an annular air passage therebetween, the fuel tube assembly having an air inlet to the annular air passage in an upper portion of the fuel feed tube assembly, a fuel tip connected to the air tube at the lower end of the fuel feed tube assembly, fuel tip including a generally cylindrical side wall and a transverse wall which extends below the air tube and fuel tube, the transverse wall having a bottom fuel inlet, a restricting rod movably mounted within the bottom fuel inlet and having a small-diameter portion and a large-diameter portion below the small-diameter portion, the restricting rod being movable between a starting position in which the large-diameter portion restricts flow of liquid fuel through the bottom fuel inlet and a running position in which the small-diameter portion is positioned with the bottom fuel inlet, the restricting rod being responsive to flow of liquid fuel through the bottom fuel inlet when the control valve is opened for moving to its starting position for restricting the flow of liquid fuel through the bottom fuel inlet whereby air flows from the upper portion of the fuel tank through the air passage and into the fuel passage and is entrained with liquid fuel which flows through the bottom fuel inlet into the fuel passage, the restricting rod falling to the running position when fuel in the generator tube is vaporized whereby flow of liquid fuel through the bottom fuel inlet is unrestricted and flow of air through the air passage is discontinued.

12. The fuel control mechanism of claim 11 in which the restricting rod includes an elongated shank and a flange which extends transversely outwardly from the shank.

* * * * *